United States Patent [19]

Lane et al.

[11] Patent Number: 4,913,360

[45] Date of Patent: Apr. 3, 1990

[54] SHEET HANDLING APPARATUS

[75] Inventors: Martin Lane; Thompson Colin L., both of Hampshire, England

[73] Assignee: De La Rue Systems Ltd., United Kingdom

[21] Appl. No.: 193,921

[22] Filed: May 13, 1988

[30] Foreign Application Priority Data

May 15, 1987 [GB] United Kingdom ..... 8711499

[51] Int. Cl.[4] ..... B02C 4/28

[52] U.S. Cl. ..... 241/223; 241/236

[58] Field of Search ..... 271/187, 315; 241/101.7, 236, 101.2, 34, 223, 224, 100

[56] References Cited

U.S. PATENT DOCUMENTS

| | | | |
|---|---|---|---|
| 3,831,505 | 8/1974 | Skogsberg . | |
| 3,974,748 | 8/1976 | Bethke . | |
| 4,145,038 | 3/1979 | Mol | 271/315 X |
| 4,166,030 | 8/1979 | Lewis et al. | 241/236 X |
| 4,346,851 | 8/1982 | Bernardi et al. . | |
| 4,500,002 | 2/1985 | Koshio et al. | 271/187 X |
| 4,565,363 | 1/1986 | Faltin . | |
| 4,619,407 | 10/1986 | Goldhammer | 241/236 X |

FOREIGN PATENT DOCUMENTS

| | | | |
|---|---|---|---|
| 2403838 | 1/1974 | Fed. Rep. of Germany . | |
| 2634375 | 7/1976 | Fed. Rep. of Germany . | |
| 1406856 | 11/1965 | France | 271/187 |
| 2176386 | 3/1973 | France . | |
| 2393613 | 6/1978 | France . | |
| 2058607 | 6/1978 | United Kingdom . | |
| 2102394 | 6/1982 | United Kingdom . | |

*Primary Examiner*—Mark Rosenbaum

*Attorney, Agent, or Firm*—Ostrolenk, Faber, Gerb & Soffen

[57] ABSTRACT

A system for destroying sheets, particularly banknotes, comprises a first feed system (13) for feeding sheets at a first feed speed to sheet destruction apparatus, a second feed system (2) upstream of the first system (13) for feeding sheets at a second feed speed faster than the first feed speed, and a buffer system comprising a stacking wheel (9) positioned between the first and second feed systems to transfer sheets from the second system to the first system and to compensate for the difference in feed speeds. Typically, the sheet destruction apparatus is a low speed shredder (14).

15 Claims, 5 Drawing Sheets

SHEET HANDLING APPARATUS

FIELD OF THE INVENTION

The invention relates to a sheet destruction system and in particular a system for destroying documents such as banknotes.

DESCRIPTION OF THE PRIOR ART

Conventional high speed banknote sorting machines typically feed banknotes at linear speeds in the order of 144 m/min. One of the major uses of such banknote sorting machines is to sort banknotes into fit (acceptable) and unfit (unacceptable) notes, the fit notes being recirculated and the unfit notes being destroyed by shredding. It is known to provide an "on-line" shredding facility associated with a banknote sorting machine in which a single unfit banknote issuing from the exit rollers of the sorting machine is almost instantly applicable to the cutters of the shredding apparatus as described in British Patent Application No. 2,058,607. In order to avoid jamming during this transfer, it is important for the feed speeds of the banknote sorting machine and the shredding facility to be substantially the same and ensure that the banknotes are aligned and not skewed, as described in British Patent Application No. 2,102,394. Such strip shredding produces strips of the order of 2 mm to 3 mm strip width and this results in a relatively large bulk volume for the shredded material.

An alternative shredding facility is known in the office equipment field which produces a cross-cut shredding of sheets with dimensions of for example 1.5×12.5 mm to 0.9×9.5 mm shreds. However, typical cross-cut shredders which produce shreds of this size operate at a relatively low cutting speed of 10–30 m/min. This low speed operation is a consequence of the low cost construction of such shredding facilities where opposite and adjacent cutting blades can contact as they operate with the blades being typically stamped from sheet metal and treated to increase their wear properties. Rubbing contact of the blades at such low speeds does not present great problems. However, any attempt to operate this type of shredder at the high banknote sorting speed of 144 m/min would result in high wear, noise and temperature generated by the contacting cutting blades and, therefore it is not possible to use a conventional cross-cut shredder with a high speed banknote sorting machine. To produce a shredder which could operate at 144 m/min would require precision blades mounted such that adjacent blades do not contact and a gap of less than 0.1 mm is maintained between them. The cost of such a shredder is prohibitively high.

SUMMARY OF THE INVENTION

In accordance with the present invention a sheet destruction system comprises sheet destruction apparatus, a first feed system for feeding sheets at a first feed speed to the sheet destruction apparatus, a second feed system upstream of the first system for feeding sheets at a second feed speed faster than the first feed speed, and a buffer system between the first and second feed systems to transfer sheets from the second to the first system and to compensate for the difference in feed speeds.

This invention deals with the problems of associating feed systems and a sheet destruction apparatus which operate at different speeds by interposing a buffer system between the two feed systems. The invention is particularly applicable for use in banknote or other document (particularly security document) handling in which the first feed system includes sheet destruction apparatus such as shredder apparatus (preferably of the cross-cut type) and the second feed system forms part of a high speed banknote sorting machine.

The invention also provides a self-contained unit which can be associated with any conventional sheet feeding machine and this is particularly useful in the case of a banknote shredder since the first feed system should be contained within a secure environment.

Preferably, the buffer system comprises a stacking mechanism for stacking sheets which it receives on to the first feed system. Typically, depending on the relative speeds of the feed to the buffer system and the first feed system and the relative spacing of sheets fed to the buffer system, the buffer system will cause the sheets to be stacked in an overlapping manner on the first feed system. In one arrangement, the first feed system can be intermittently operated so that an aligned stack of sheets is formed and then the first feed system operated to convey the stack away from the buffer system. Preferably, however, the second feed system is continuously operated.

The stacking of sheets either partially or completely overlapped leads to much smaller bulk shreds than from single sheets.

Typically, the ratio of the first feed speed to the second feed speed is in the range of substantially 1:14 to 1:4.

In the preferred embodiment, the buffer system comprises at least one rotatably mounted stacking wheel having a plurality of radially outwardly opening slots for receiving respective single sheets, and stripper means cooperating with the or each stacking wheel to strip sheets from the slots during rotation of the stacking wheel, the stripped sheets passing to the first feed system.

Typically, the first feed system will comprise at least one conveyor belt and, where the first feed system includes destruction apparatus, this apparatus can be of a conventional form such as a strip shredder or, preferably, a cross-cut shredder.

BRIEF DESCRIPTION OF THE DRAWINGS

Two examples of a banknote destruction system in accordance with the present invention will now be described with reference to the accompanying drawings, in which.

DETAILED DESCRIPTION OF THE DRAWINGS

Figure 1:
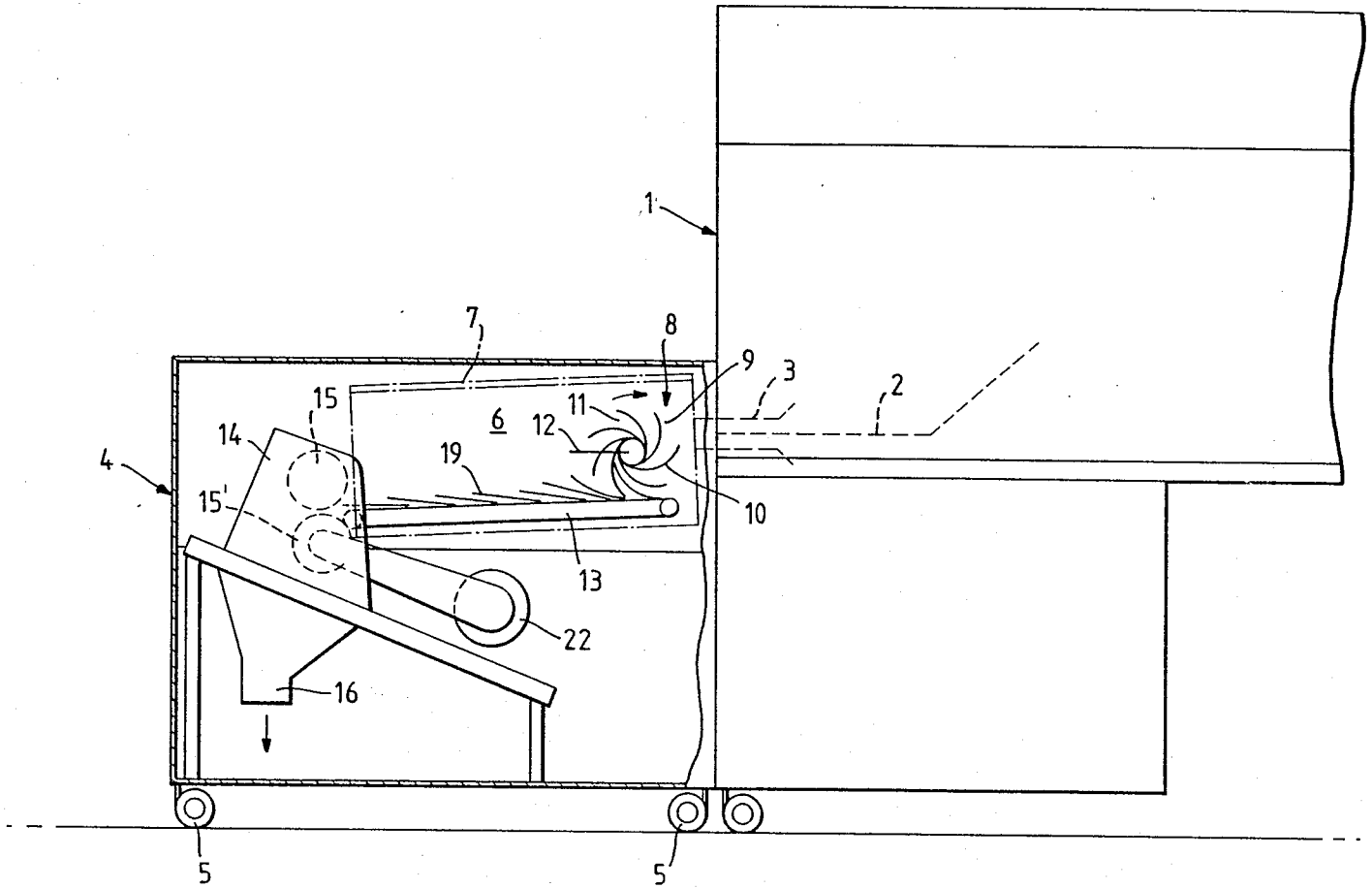
FIG. 1 is a schematic side elevation of a first example of the system.

The system shown in FIG. 1 comprises a banknote sorting machine 1 such as out 3200 high speed banknote sorting machine in which banknotes are sorted into fit and unfit notes with the unfit notes being fed by a feed system 2 to an exit track 3. Typically the unfit notes will be fed spaced apart at a speed of about 144 m/min.

A self-contained shredder unit 4, comprising a secure region 6 and cutting mechanism 14 mounted resiliently to the secure region 6, is mounted on wheels 5 for ease of transportation. The cutting mechanism 14 is resiliently mounted by means of rubber mountings, to walls 7 of the secure area 6 to reduce the overall noise level. The shredder unit 4 also has jacking feed (not shown) which are used when the shredder unit 4 is in the operating position to align and level the shredder unit 4 with the sorting machine 1.

The shredder unit 4 is coupled with the banknote sorting machine 1 such that the exit track 3 of machine 1 extends through an aperture (not shown) in a wall of the unit 4 and opens into the secure region 6 (defined by walls 7 and a clear polycarbonate access door (not shown)).

The use of clear polycarbonate in the access door allows the shredding operation to be viewed.

Within the secure region 6 is mounted a buffer system 8 comprising at least one conventional stacking wheel 9 having a plurality of generally outwardly extending tines 10 defining between them respective sheet receiving slots 11. A stripper plate 12 is fixed within the secure area 6 and extends between the stacking wheels 9.

Beneath the stacking wheels 9 and within the secure area 6 is mounted a main conveyor system 13 which extends to the entrance of a conventional cutting mechanism 14.

The cutting mechanism 14 comprises a number of cutting wheels shown schematically by reference numeral 15, 15' between which banknotes are fed. The cutting wheels 15, 15' slice the banknote into a number of shreds, the resulting shreds dropping through an exit port into a collection bin or into a funnel 16 connected to vacuum extraction equipment (not shown).

Figure 4:
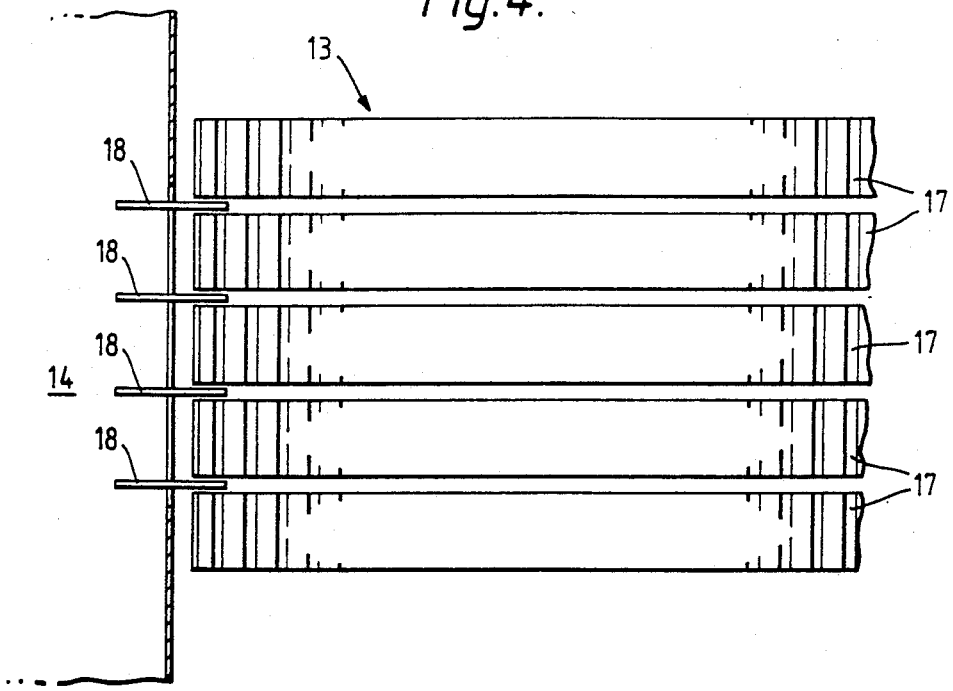
FIG. 4 illustrates part of the shredder used in both the FIGS. 1 and 2 examples in more detail.
Figure 5:
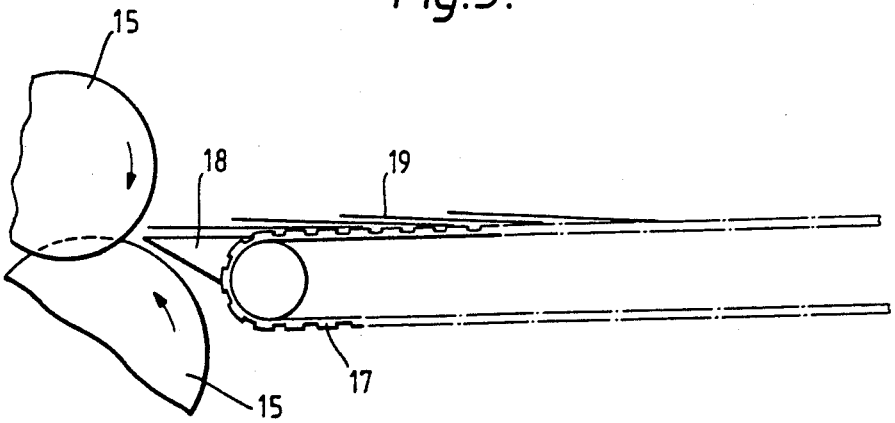
FIG. 5 is a partial side elevation of the shredder conveyor shown in FIG. 4; and, FIG. 6 illustrates part of the feed system for the shredder shown in FIG. 2, with the stacking wheel omitted.

FIG. 4 is a partial plan view of the entrance to the cutting mechanism 14. The conveyor system 13 comprises twelve laterally spaced belts 17 of which only five are shown for clarity. The belts 17 extend from the stacking wheels 9 to the cutting mechanism 14. The conveyor system 13 can include more or less than twelve belts. In order to prevent banknotes conveyed by the system 13 from following the conveyor system 13 around past the cutting mechanism 14 without entering the mechanism 14, stripping fingers 18 are provided between adjacent belts 17. The position of the fingers 18 can be seen more clearly in FIG. 5 which also shows that the belts 17 have outwardly extending teeth to assist in conveying notes 19.

The total width of the conveyor system 13 is greater than the length of the longest banknote to be handled but is less than the width of the entrance to the cutting mechanism 14.

In operation, unfit banknotes are fed singly and spaced apart in the feed direction by the feed system 2 slots 11 in the stacking wheels 9 which rotate in clockwise direction as seen in FIG. 1. The banknotes are fed to the stacking wheels 9 at a rate of about 10 notes per second (equivalent to a feed speed of 144 m/min).

As the stacking wheels 9 rotate, the radially inner edge of each banknote engages the stripper plate 12 so that the banknote is pushed out of its slot 11 and drops down onto the conveyor system 13.

The conveyor system 13 is continuously moving at a lower speed of typically 13.5 m/min so that each banknote stripped from the stacking wheel 9 will fall down and overlap the previously stacked banknote. The series of overlapped banknotes are then fed at the slower speed to the cutting mechanism 14 where they are shredded, typically in a cross-cut manner, the shreds then exiting through the exit port.

It will be noted that in this example, the direction of feed by the conveyor system 13 to the cutting mechanism 14 is in-line with the direction of movement of the banknotes through the exit track 3. With this configuration, the direction of rotation of the stacking wheels 9 is clockwise which caters for "fliers" any banknote which does not stack properly which with this configuration and direction of rotation would fall below the stacking wheels and eventually be picked up by the main conveyor system 13.

Figures 2, 2A:
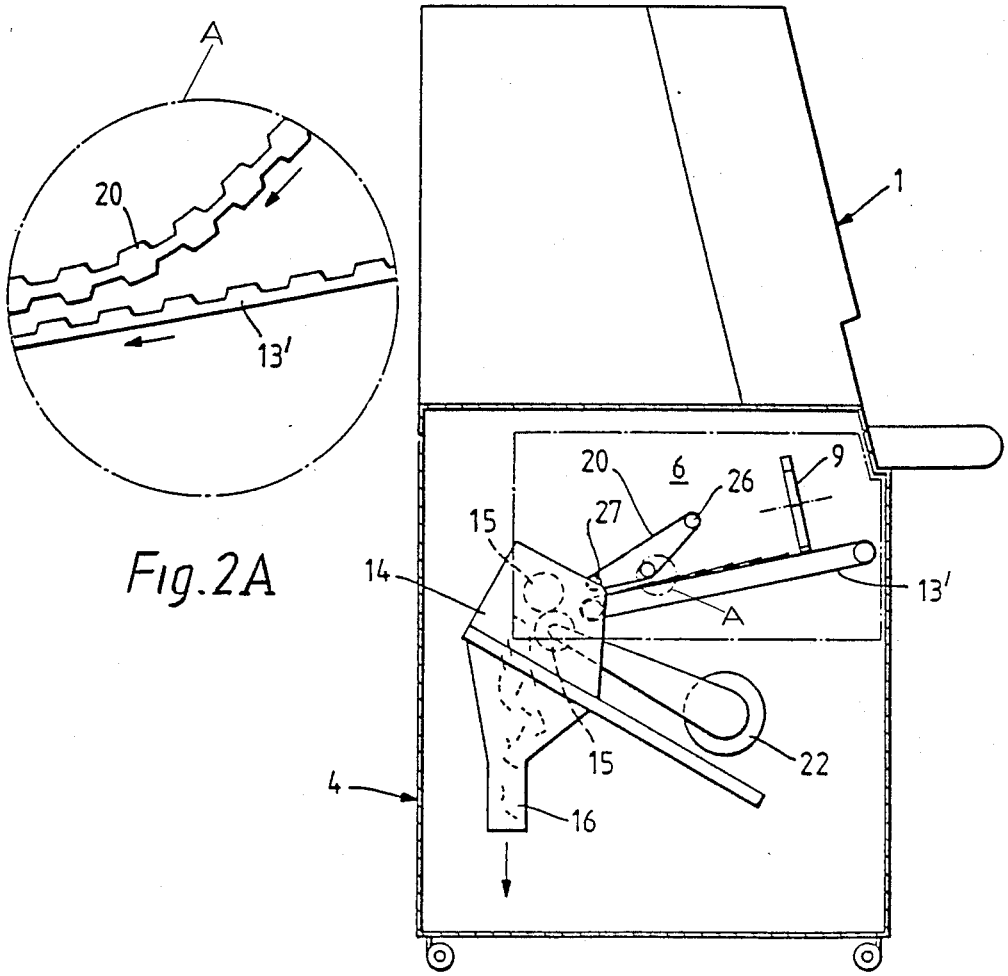
FIG. 2 is a schematic end view of a second example of the system.
FIG. 2A illustrates part of the feed system of FIG. 2.
Figure 3:
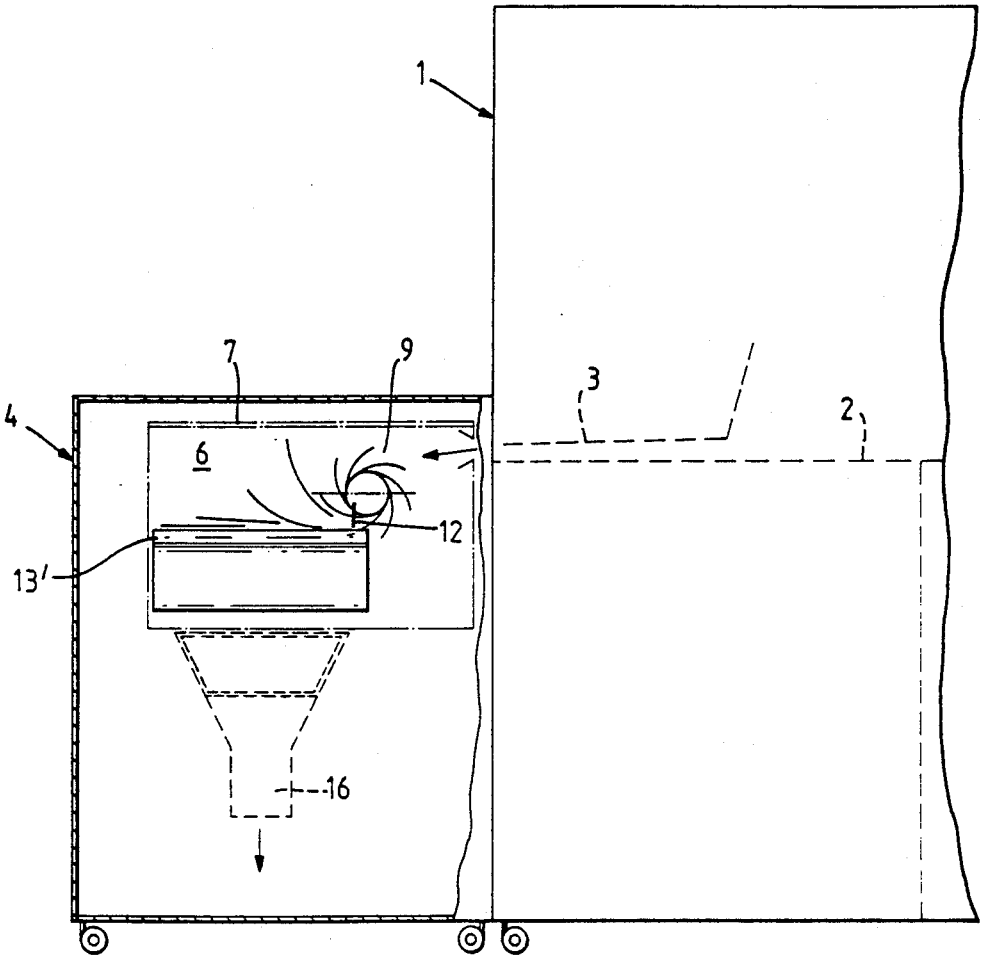
FIG. 3 is a schematic front view of the system shown in FIG. 2.

FIGS. 2 and 3 illustrate a second example of the system in which a main conveyor system 13' conveys banknotes in a direction at right angles to the direction in which they are fed through the exit track 3. The advantage of this can be seen in FIG. 2 where it will be seen that the main conveyor system 13' and the cutting mechanism 14 are accommodated within the width of the sorting machine 1 thus providing a significant space saving over the embodiment of FIG. 1. This configuration also enables the cutting mechanism 14 to be placed in the most remote position relative to the operator which improves environmental conditions for the operator, by reducing the amount of noise and dust. For simplicity, those elements of the embodiment of FIG. 2 which are substantially the same as the embodiment of FIG. 1 have been given the same reference numerals.

The embodiment of FIG. 2 also differs from the embodiment of FIG. 1 in providing an auxiliary belt 20 extending the full width of the system 13'. The belt 20 has double teeth, one set on each side of the belt and is provided to assist in keeping badly distorted notes or fliers held down on the main conveyor system 13'. Alternatively the belt 20 could be plain and have a high friction surface in contact with the belt 13'. The auxiliary belt 20 could also be used with the embodiment shown in FIG. 1.

In addition to its compactness, an additional advantage of the embodiment of FIG. 2 is that feeding of notes with the long edge foremost results in reduced wear on the cutting blades per x notes destroyed. Typically, the length:width ratio of a banknote is 2:1 and therefore a single blade would typically cut 50% less paper if destruction were long edge first. Moreover, "fliers" impinge on the opposite wall and then come to rest on the conveyor 13' and thus cannot block the shredder throat directly which reduces the likelihood of jams.

Figure 6:
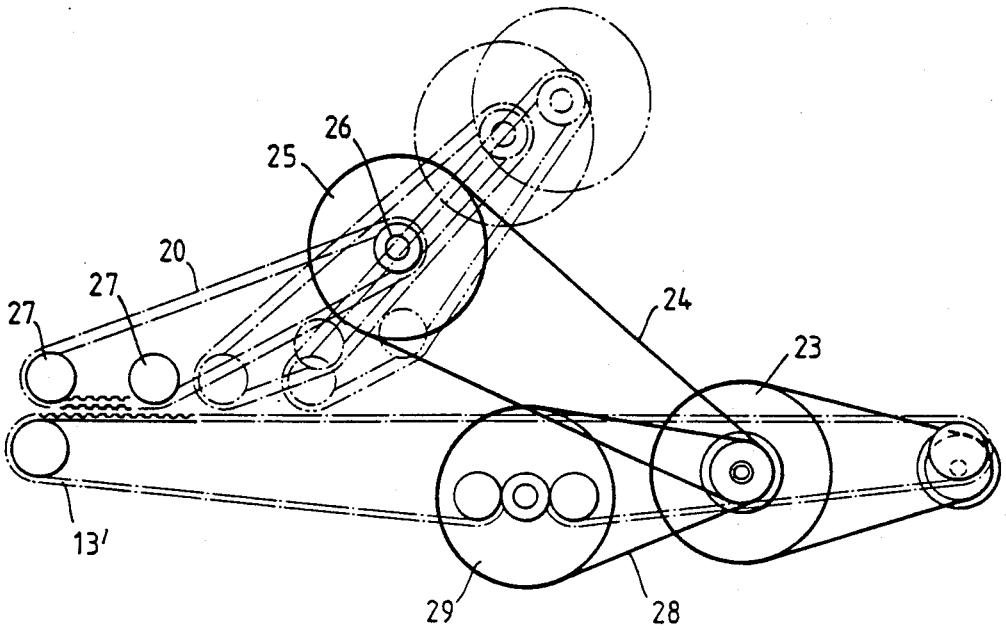

The system for driving the shredder in the unit 4 has been omitted from FIGS. 1 to 3 except for an indication by reference number 22. FIG. 6 shows the drive arrangement for the conveyor system 13' and belt 20 in more detail for the embodiment of FIG. 2 in which a motor (not shown) drives a pulley 23 coupled via a drive belt 24 to a pulley 25 coupled, non-rotatably, to pulley 26 about which the belt 20 is entrained. The belt 20 is also entrained around pulleys 27. The main conveyor system 13' is also driven from the pulley 23 via a drive belt 28 and a drive pulley 29.

The stacker wheels 9 are driven separately by a motor (not shown) at a speed similar to that of the feed system 2.

In order to gain access to the conveyor system 13', the pulleys 26, 27 are movable as a unit from the position shown in solid lines in FIG. 6 to the position shown in dashed lines.

The degree of overlap of banknotes 19 may be considered as follows. The main conveyor system 13 or 13' in this case is designed to run at 13.5 m/min (0.22 m/sec) to feed the cutting mechanism 14 at its designed cutting speed. The stacking wheels 9 are arranged to receive and deliver 10 notes per second onto the conveyor system 13, 13' so that each note is advanced 22 mm by the conveyor system 13, 13' in front of its succeeding neighbour. Alternatively, if the length of a note in the feed direction is 88 mm, the degree of overlap could be considered to be 66/88 or 75%.

In the embodiments of the invention shown in Figures 1 to 3, due to the low speed of the cutting mechanism 14, damaged banknotes or badly presented and even skewed banknotes will not jam the cutting mechanism 14. The ability to shred even skewed banknotes is an unexpected advantage adding considerably to the security of the system as the randomness of the skewed banknotes ensures no shred is identical in terms of its feature. This is further enhanced if a cross-cut shredder is used as the cutting mechanism 14, as the shreds from a cross-cut shredder are relatively small compared with conventional cutting mechanisms. The smaller shred size also reduces waste bulk. In fact the configuration shown in FIGS. 2 and 3 actually contributes to the amount of skew of the banknotes by having the conveyor system 13' perpendicular to the feed system 2, and this configuration is therefore preferable to the configuration of FIG. 1.

We claim:

1. A sheet destruction system, comprising: sheet destruction apparatus;

a first feed system for feeding sheets along a first path at a first feed speed to said sheet destruction apparatus;

a second feed system upstream of said first system for feeding sheets along a second path at a second speed faster than said first speed; and a buffer system between said first and second feed systems to transfer sheets from said second to said first system and to compensate for said difference in feed speeds;

wherein said first and second feed systems and said buffer system comprise means for transferring said sheets to said sheet destruction apparatus at random angles of skew.

2. A system according to claim 1, wherein said first path is transverse to said second path.

3. A system according to claim 2, wherein said first path is substantially perpendicular as viewed in a horizontal plane to said second path.

4. A system according to claim 1, wherein said second feed system is formed by part of a sheet sorting machine.

5. A system according to claim 1, wherein said destruction apparatus comprises a cross-cut shredder.

6. A system according to claim 1, wherein the ratio of said first feed speed to said second feed speed is in the range of substantially 1:14 to 1:4.

7. A system according to claim 1, wherein said buffer system comprises a stacking mechanism for stacking sheets which it receives on to said first feed system.

8. A system according to claim 7, wherein said buffer system comprises at least one rotatably mounted stacking wheel having a plurality of radially outwardly opening slots for receiving respective single sheets, and stripper means cooperating with said or each stacking wheel to strip sheets from said slots during rotation of said stacking wheel, said stripped sheets passing to said first feed system.

9. A system according to claim 2, wherein said buffer system comprises a stacking mechanism for stacking sheets which it receives on to said first feed system.

10. A system according to claim 9, wherein said buffer system comprises at least one rotatably mounted stacking wheel having a plurality of radially outwardly opening slots for receiving respective single sheets, and stripper means cooperating with said or each stacking wheel to strip sheets from said slots during rotation of said stacking wheel, said stripped sheets passing to said first feed system.

11. A system according to claim 1, further including banknotes passing through said feed systems into said sheet destruction apparatus.

12. A method of destroying sheets, said method comprising the steps of:

feeding said sheets along a first path at a first speed from a supply position to a sheet destruction system at which they are destroyed;

feeding said sheets along a second path towards said supply position at a second speed faster than said first speed; and decelerating said sheets at said supply position in such a way as to compensate for the difference in said feed speeds;

wherein said feeding and deceleration of said sheets results in said sheets being fed at random angles of skew to said sheet destruction system.

13. A method according to claim 12, wherein said first path is transverse to said second path.

14. A method according to claim 13, wherein said first path is substantially perpendicular as viewed in a horizontal plane to said second path.

15. A method according to claim 12, wherein the ratio of said first feed speed to said second feed speed is in the range of substantially 1:14 to 1:4.

* * * * *